United States Patent [19]

Shin

[11] Patent Number: 4,896,978

[45] Date of Patent: Jan. 30, 1990

[54] METHOD FOR OPTIONAL CONTROL OF LINE SPACING IN ELECTRONIC TYPEWRITER

[75] Inventor: Bong Y. Shin, Suwon, Rep. of Korea

[73] Assignee: Samsung Electronics Co., Ltd., Suwon, Rep. of Korea

[21] Appl. No.: 216,170

[22] Filed: Jul. 7, 1988

[30] Foreign Application Priority Data

Jul. 14, 1987 [KR] Rep. of Korea ..... 1987-7608[U]

[51] Int. Cl.[4] ..... B41J 19/96

[52] U.S. Cl. ..... 400/555; 400/551; 400/582

[58] Field of Search ..... 400/549, 550, 551, 555, 400/567, 568, 571, 582, 583, 583.1, 583.2, 583.3, 583.4, 611, 65, 76, 307.2, 902

[56] References Cited

U.S. PATENT DOCUMENTS

| | | | |
|---|---|---|---|
| 3,872,959 | 3/1975 | Wang et al. | 400/65 |
| 3,888,340 | 6/1975 | Hoffman | 400/611 |
| 4,037,705 | 7/1977 | Martin et al. | 400/582 X |
| 4,195,940 | 4/1980 | Rekewitz | 400/567 X |

FOREIGN PATENT DOCUMENTS

| | | | |
|---|---|---|---|
| 89376 | 5/1983 | Japan | 400/611 |
| 236776 | 11/1985 | Japan | 400/582 |

*Primary Examiner*—David A. Wiecking
*Attorney, Agent, or Firm*—Robert E. Bushnell

[57] ABSTRACT

A process for controlling line spacing, including the steps of clearing or setting line pitch variable mode in a first state; checking keyboard input in a second stage; determining whether the keyboard input indicates line pitch variable mode, and performing a function corresponding to keyboard input in a third stage if the keyboard input does not indicate line pitch variable mode; setting the length specified in a fourth stage if the keyboard indicates a specified length of line spacing; in a fifth stage, if the keyboard does not indicate a specified length in the fourth stage, returning the carriage through feeding by the length of the variable line pitch and returning to the first stage when the keyboard input in the fifth stage does not indicate a return function, line feeding by the length of the variable line pitch and returning to the first stage when the keyboard input indicates an index key; in a seventh stage, if the keyboard input in the sixth stage does not indicate an index key, performing a reverse index function and returning to the first stage when the keyboard input indicates a reverse index, and reverse line feeding by the length of the variable line pitch when the keyboard input in the seventh stage indicates a reverse index key in an eighth stage.

6 Claims, 3 Drawing Sheets

METHOD FOR OPTIONAL CONTROL OF LINE SPACING IN ELECTRONIC TYPEWRITER

BACKGROUND OF THE INVENTION

This invention relates to a method for driving an electronic typewriter and in particular a method capable of controlling line spacing in the typewriter so as to be suitable for user's needs by the optional control of line pitch in printing.

The conventional typewriter usually has two or three fixed pitches in setting line spacing to be selected by an user. Although sufficient for most typing needs, it becomes inconvenient when typing on a formatted special sheet because the user has to adjust the line pitch manually to fit within the lines. This process is time consuming and bothersome. Furthermore, resetting to the exact position of a previously typed line is quite difficult, making the correction nearly impossible. Moreover, because the adjustment of line spacing is carried out manually, it tends to be inaccurate.

SUMMARY OF THE INVENTION

An object of the invention is, therefore, to provide a method of accurate adjustment as desired by the user, by assigning the line pitch at the smallest possible driving unit of a driving motor in an electronic typewriter.

This and other objects of the invention are achieved by a method for controlling line spacing in the typewriter, in which here are a:

(a) first stage for setting or clearing line pitch variable mode;

(b) second stage for checking key input following the first stage;

(c) third stage for judging whether or not the key input is for line pitch variable mode, when being the key input, following the second stage, and, when not being the key input, performing a function according to the corresponding key, then returning to the first stage;

(d) fourth stage for judging whether or not the key input is for a set key to set up the line spacing with a specified length, and, when it is for the set key, setting the corresponding key data to be received an amount of variable line pitch;

(e) fifth stage for judging whether or not the key input is for a return key, when it is not the set key in the fourth stage, and, when it is the return key, returning the carriage through feeding the line by the length of the variable line pitch, then returning the control procedure to the first stage;

(f) sixth stage for judging whether or not the key input is for an index key, when it is not the return key in the fifth stage, and, when it is in the index key, feeding the line by the length of the variable line pitch, then returning the control procedure to the first stage;

(g) seventh stage for judging whether or not the key input is for a reverse index key, when it is not the index key in the sixthh stage, and, when it is not the reverse index key, performing the operation according to the corresponding key, then returning the control procedure to the first stage; and (h) eighth stage for reversely feeding the line by the length of the variable line pitch when the key input is the reverse index key in the seventh stage.

The invention will be better understood by reference to the following detailed description taken in connection with accompanying drawings.

DETAILED DESCRIPTION OF THE INVENTION

Figure 1:
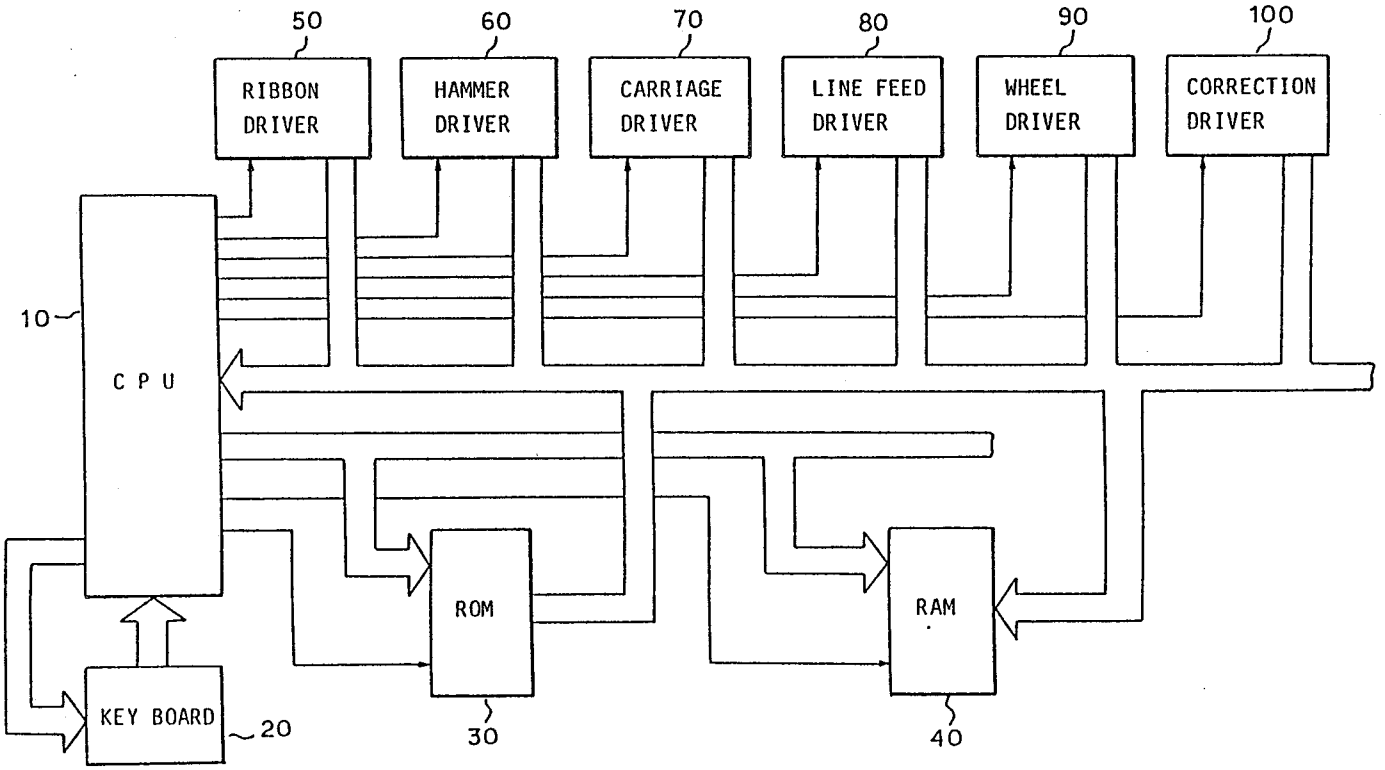
FIG. 1 is a block diagram of a conventional typewriter system for use in this invention.

Hereinafter, the present invention will be described in detail with reference to the accompanying drawings. Referring to FIG. 1, a block diagram for the system for use in the invention, said system comprises a CPU 10 (Central Processing Unit) for controlling and directing all the control procedure in the system, a key board 20 for outputting key data according to operator's key inputting a ROM 30 (Read Only Memory) including therein a control program according to the invention, a RAM 40 (Random Access Memory) for reading and writing the key data and others under the control of the CPU 10, a ribbon driver 50 for driving a ribbon motor through the control of the CPU, a hammer driver 60 for driving a hammer to print a character, a carriage driver 70 for driving a carriage motor, a line feed driver 80 for driving a line feeding motor, a wheel driver 90 for driving a wheel motor and a correction driver 100 for driving a correction motor.

Figure 2:
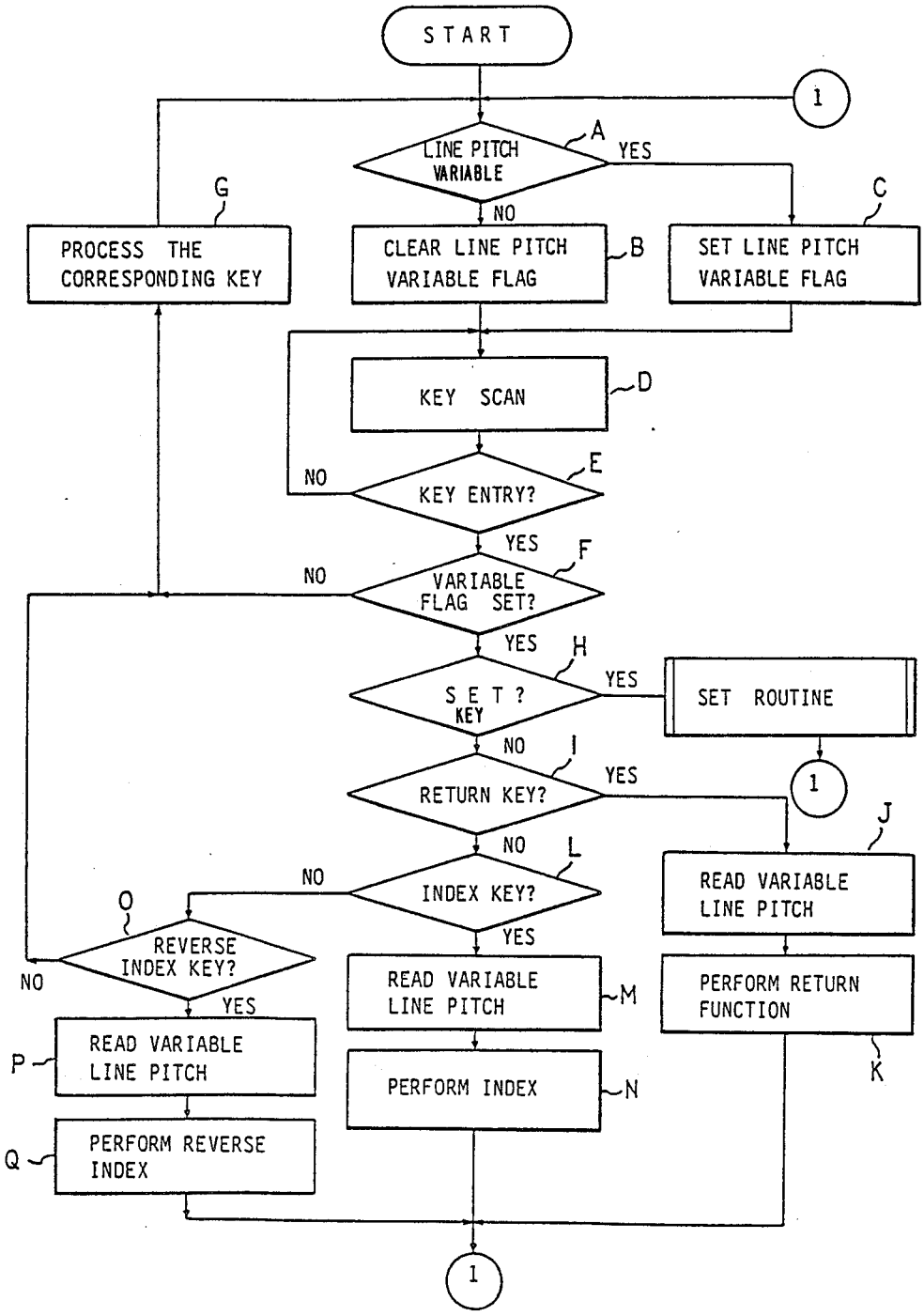
FIG. 2 is a flow chart of the method according to the invention.

FIG. 2 is a flow chart diagram illustrating every step of the control procedure for controlling line spacing in an electronic typewriter according to the invention. Said control procedure includes a:

(a) first stage for setting or clearing line pitch variable mode;

(b) second stage for checking key input following the first stage;

(c) third stage for judging whether or not the key input is for line pitch variable mode, when being the key input, following the second stage, and, when not being the key input, performing a function according the corresponding key, then returning to the first stage;

(d) fourth stage for judging whether or not the key input is for a set key to set up the line spacing with a specified length, and, when it is for the set key, setting the corresponding key data to be received by an amount of variable line pitch;

(e) fifth stage for judging whether or not the key input is for a return key, when it is not the set key in the fourth stage, and, when it is the return key, returning the carriage through feeding the line by the length of the variable line pitch, then returning the control procedure to the first stage;

(f) sixth stage for judging whether or not the key input is for an index key, when it is not the return key in the fifth stage, and, when it is the index key, feeding the line by the length of the variable line pitch, then returning the control procedure to the first stage;

(g) seventh stage for judging whether or not the key input is for a reverse index key, when it is not the index key in the sixth stage, and, when it is not the reverse index key, performing the operation according to the corresponding key, then returning the control procedure to the first stage; and (h) eighth stage for reversely feeding the line by the length of the variable line pitch when the key input is the reverse index key in the seventh stage.

Figure 3:
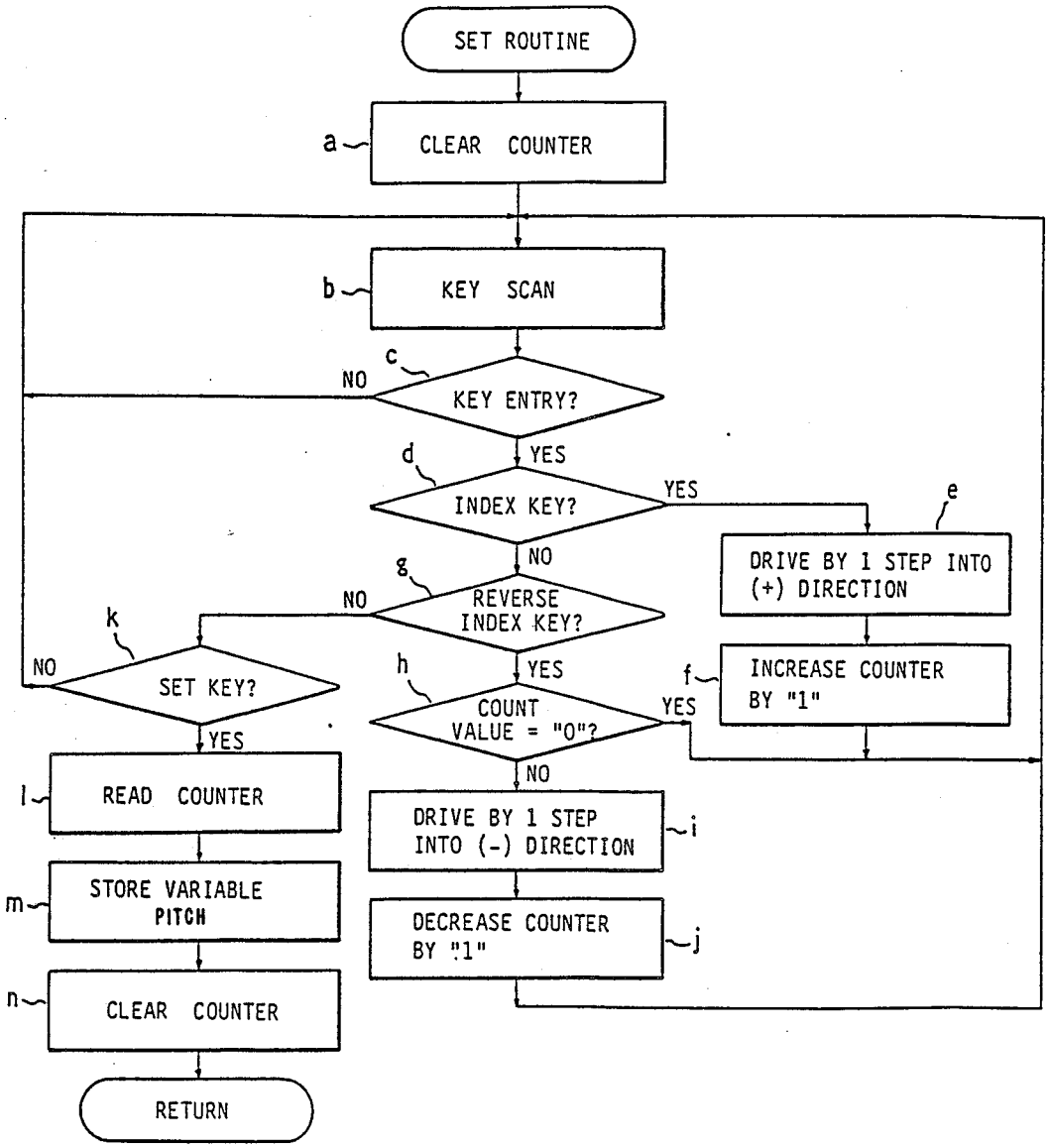
FIG. 3 is a flow chart of a subroutine for controlling line spacing in FIG. 2.

FIG. 3 is a flow chart according to a subroutine of the step 4 for assigning a desired pitch when the variable mode in the FIG. 2 is selected.

The invention will be further discussed hereunder with reference to the FIGS. 1, 2 and 3. FIG. 1 illustrates the system block diagram for the performance of this invention. Data entries from the key board (20) are read by CPU(10) and then sent to RAM(40) by CPU(10) for temporary storage which can be recalled by, for example, using the keyboard, and keying to function according to the programs of ROM(30). The CPU(10), referring to the temporarily stored data at RAM(40), calculates movements of carriage and then outputs the driving data for the servo-motor to the carriage driver (70) and controls the carriage driver by shifting to the right as required to the print position and then calculates the letter position and decides print wheel driving data, data shift number and shifting direction to send to the wheel driver (90) and drives the print wheel motor. Instantly when the wheel stops at the desired point, the hammer driver (60) is driven to print. By the control of CPU(10), the ribbon feed motor of the ribbon driver (50) feeds the appropriate length of ribbon according to the data output from the RAM(40).

When moving print position up/down, the line feed motor of the line feed driver (80) is driven to make necessary adjustments. In case of a print error, the correction key of the Keyboard (20) is pressed and CPU(10) receives the key input and reads out the driving data from RAM(40). The correction solenoid of the correction driver (100) is driven to feed the correction ribbon and remove the error.

Now, the control procedure of the invention will described as follows. The operator makes the line feed driver (80) operate with the minimum driving unit of the line feed motor and registers it with a specified amount. To make use of the length for a pitch between the lines, there should be adjusted a slide switch for controlling the pitch between the lines on the keyboard (20). Step A checks whether or not the pitch between the lines into the variable mode. When the pitch is selected into the variable mode, the variable mode flag is set, and, when the pitch is not the variable mode, it is cleared. Then, the CPU(10) scans the keyboard (20) and analyzes the key input from the CPU. When there is a key input, it is judged whether or not the variable mode flag is now set. If the flag is not set, the CPU performs the operation corresponding to the key input and then returns. If the flag is set into the variable mode, it is checked whether or not the input key from the keyboard is for a set key to set the pitch between the lines into a specified spacing from the present line spacing. When it is the key input from the set key, the control procedure proceeds to a subroutine as shown in FIG. 3, thereby deciding the desired pitch between the lines.

When the set key is entered, the CPU(10) clears the count value of line setting counter which stores the existing line pitch in step (a) and then accepts the new entry for setting up a line spacing. As the CPU(10) scans key entries from the keyboard (20), it first examines if the keying is the index instruction or not in step (d). If yes, it drives the line feed driver (80) by 1 minimum step (1/60 inch approx.) to the direction to raise the paper with line feed motor, adds the count value by 1 and then returns to the key scanning routine to await next key entry. The reason why the line feed motor is driven one by one step in the minimum driving unit is to adjust the line pitch in a precise manner so that user's needs can be met easily.

When the key entry is not the index key, it is judged in step g if the key entry is the reverse index key or not. The control procedure then advances to step (h) and checks the counter value. If the counter value is 0, then it returns to the key scan step ignoring entries, and if the count is about 0, it drives the line feed motor by one minimum drive step to the direction to lower the paper and subtracts one count. Then, it returns to the key scan step.

If the keying is not index, it is judged in step k if the keying is the set key. When the set key is pressed once, it will enable the set key to become a key for setting an user's desired line spacing, and if pressed twice, it performs a function to escape the first set function.

In the step (k), if the keying is not for the set key, then the key should be either a print key or a function key (other than index or reverse index) so that the keying will be ignored and it will return to key-scan routine. If the key is for the set key, it reads from the counter or a stored count of line pitch as set by the user, stores the changed line pitch into an area of RAM(40) and returns to the main routine as shown by the FIG. 2 after clearing the counter.

In step (H) of FIG. 2, if the key entry is not the set key, then it judges if the entry is for the return key in step (I). If it is for carriage return, it reads the value of variable line pitch saved in RAM(40) and drives the line feed motor to feed lines to the value obtained by reading, and then the control procedure returns to step (A).

In the step (I), if the key entry is not carriage return, then it is judged if it is the index key in step (L) or not. If yes, it reads from RAM(40) the value of variable line pitch and feeds the line as much as the value.

In said step (L), if the key entry is not the index key, it is judged at stage (0) if the key is reverse index key or not. When it is not the reverse index key, it is a print key or a functional key. Therefore, the control procedure performs the corresponding key processing according to the key entry and then it returns to step (A). If it is the reverse index, it drives line feed motor to feed lines reversely as much as the variable line pitch value read from RAM(40) and then returns to step (A).

As discussed above, the invention enables a user to set any length of line-feed of variable pitch for adjusting by a minimum driving step to yield precise line spacing and arrangement in various formats, eliminating the need of manual adjustment for entries in formated sheets and allowing in the correction mode accurate alignment on the print.

While the invention has been particularly shown and described with reference to a preferred embodiment, it will be understood by those skilled in the art that modifications in detail may be made without departing from the spirit and scope of the invention.

What is claimed is:

1. A method for optionally controlling line spacing in an electronic typewriter, said method comprising the control procedure of:

(a) first stage for setting or clearing a variable line pitch mode;

(b) second stage for checking key input following the first stage;

(c) third stage for judging whether the variable line pitch mode has been set, and if the variable line pitch mode not been set, performing a function according to the corresponding key, then returning to the first stage;

(d) fourth stage for judging whether or not the key input is a set key to set-up the line spacing with a specified length, and, when key input is the set key, setting the corresponding key data to be received by an amount of variable line pitch;

(e) fifth stage for judging whether or not the key input is a return key when key input is not the set key in the fourth stage, and, when key input is the return key, returning the carriage through feeding the line by the amount of the variable line pitch, then returning the control procedure to the first stage;

(f) sixth stage for judging whether or not the key input is an index key when key input is not the return key in the fifth stage, and, when key input is the index key, feeding the line by the amount of the variable line pitch, then returning the control procedure to the first stage;

(g) seventh stage for judging whether or not the key input is a reverse index key, when key input is not the index key in the sixth stage, and, when key input is not the reverse index key, performing the operation according to the corresponding key, then returning the control procedure to the first stage; and (h) eighth stage for reversely feeding the line by the amount of the variable line pitch when the key input is the reverse index key in the seventh stage.

2. A method set forth in claim 1, wherein said fourth stage for setting the amount of variable line pitch further comprises the control procedure of:

(a) first step for initializing a count value of setting length;

(b) second step for checking key input following the first step;

(c) third step for judging whether or not the key input is the index key from the second step, and, when key input is the index key, driving the motor by one step of a minimum unit into a direction to raise the paper, making a count and then returning the control procedure to the second step;

(d) fourth step for checking whether or not the key input is the reverse index key, when key input is not the index key in the third step;

(e) fifth step for judging whether or not the count value is zero, when the count value is the reverse index key in the fourth step, and, when it is zero, returning the control procedure to the second step;

(f) sixth step for driving the motor by one step of the minimum unit to the direction to lower the paper, when the count value is larger than zero, decreasing the count value and then returning the control procedure to the second step;

(g) seventh step for judging whether or not the key input is a set key, when key input is not the set key, then returning the control procedure to the second step; and (h) eighth step for clearing the count value after storing the count value read into a specified memory, when key input is the set key in the seventh step, and then returning the control procedure to the third step.

3. A method for variably optionally controlling line spacing in an electronic typewriter, said method comprising:

judging whether a variable line pitch mode has been set, and, if a variable line pitch has not been set, performing a function according to the corresponding key input, then returning to an initial stage;

judging whether the key input is a set key to set-up line spacing with a specified length, and, when key input is the set key, setting the corresponding key data to be received by an amount of variable line pitch;

judging whether the key input is a return key, when key input is not the set key, and, when key input is the return key, returning the carriage and line feeding by the amount of the variable line pitch, then returning to the initial stage;

judging whether the key input is an index key when key input is not the return key, and, when key input is the index key, line feeding by the amount of the variable line pitch, then returning to the initial stage;

judging whether the key input is for a reverse index key, when key input is not the index key, and, when key input is not the reverse index key, performing the operation according to the corresponding key, then returning to the initial stage; and reversely line feeding by the amount of the variable line pitch when the key input is the reverse index key.

4. The method set forth in the claim 3, wherein the step for setting the amount of variable line pitch further comprises the variable line pitch setting procedure of:

initializing a count value of setting length;

checking key input;

judging in a third step whether the key input is the index key, and, when key input is the index key, driving the motor by one step of a minimum unit into a direction to raise the paper, making a count and then returning to the key input checking step;

checking whether the key input is the reverse index key, when the key input is not the index key;

judging whether the count value is zero when key input is the reverse index key, and, when the count value is zero, returning to the key input checking step;

driving the motor by one step of the minimum unit in a direction to lower the paper when the count value is larger than zero, decreasing the count value and then returning to the key input checking step;

judging whether the key input is a set key, when the key input is not the reverse index key, and, when key input is not the set key, than returning to the key input checking step; and clearing the count value after storing the count value read, when key input is the set key in the seventh step, and then returning to the third step.

5. A method for variably optionally controlling line spacing in an electronic typewriter, said method comprising:

an initial stage for setting or clearing variable line pitch mode;

checking for occurrence of key input following the initial stage;

judging upon occurrence of key input, whether the variable line pitch mode has been set, and, if a variable line pitch has not been set, performing a function according to the corresponding key input, then returning to the initial stage;

judging whether the key input is a set key to set-up the line spacing with a specified length, and, when key input is the set key, setting the corresponding key data to be received as an amount of variable line pitch;

judging whether the key input is a return key, when key input is not the set key, and, when key input is the return key, returning the carriage and line feeding by the amount of the variable line pitch, then returning to the initial stage;

judging whether the key input is an index key when key input is not the return key, and, when key input is the index key, line feeding by the amount of the variable line pitch, then returning to the initial stage;

judging whether the key input is for a reverse index key, when key input is not the index key, and, when key input is not the reverse index key, performing the operation according to the corresponding key, then returning to the initial stage; and reversely line feeding by the amount of the variable line pitch when the key input is the reverse index key.

6. The method set forth in the claim 5, wherein the step for setting the amount of variable line pitch further comprises the variable line pitch setting procedure of:

initializing a count value of setting length;

checking key input;

judging in a third step whether the key input is the index key, and, when key input is the index key, driving the motor by one step of a minimum unit into a direction to raise the paper, making a count and then returning to the key input checking step;

checking whether the key input is the reverse index key, when the key input is not the index key;

judging whether the count value is zero, when key input is the reverse index key, and, when the count value is zero returning to the key input checking step;

driving the motor by one step of the minimum unit in a direction to lower the paper when the count value is larger than zero, decreasing the count value and then returning to the key input checking step; and clearing the count value after storing the count value read, when key input is the set key in the seventh step, and then returning to the third step.

* * * * *